United States Patent [19]

Adam

[11] Patent Number: 4,545,584

[45] Date of Patent: Oct. 8, 1985

[54] RACKET WITH ADJUSTABLE HANDLE

[75] Inventor: Günter Adam, Straubing, Fed. Rep. of Germany

[73] Assignee: PUMA-Sportschuhfabriken Rudolf Dassler KG, Fed. Rep. of Germany

[21] Appl. No.: 627,513

[22] Filed: Jul. 3, 1984

[30] Foreign Application Priority Data

Jul. 5, 1983 [DE] Fed. Rep. of Germany ..... 3324143

[51] Int. Cl.[4] ..... A63B 49/08

[52] U.S. Cl. ..... 273/73 J

[58] Field of Search ..... 273/73 J, 75, 73 R, 273/81.2, 81 D, 67 D, 67 DA; 16/115; 248/188.5

[56] References Cited

U.S. PATENT DOCUMENTS

| | | | |
|---|---|---|---|
| 3,833,219 | 9/1974 | Dean | 273/75 |
| 3,931,968 | 1/1976 | Hedberg | 273/75 |
| 4,033,583 | 7/1977 | Ehrhart | 273/73 R |

FOREIGN PATENT DOCUMENTS

| | | | |
|---|---|---|---|
| 942075 | 3/1956 | Fed. Rep. of Germany | 273/73 J |
| 1112435 | 12/1961 | Fed. Rep. of Germany | 273/73 J |
| 2106800 | 9/1971 | Fed. Rep. of Germany | 273/75 |
| 2029533 | 12/1971 | Fed. Rep. of Germany | 273/73 J |
| 2030998 | 12/1971 | Fed. Rep. of Germany | 273/73 J |
| 178694 | 4/1922 | United Kingdom | 273/73 E |
| 492684 | 9/1938 | United Kingdom | 273/81.2 |

*Primary Examiner*—Richard C. Pinkham
*Assistant Examiner*—Matthew L. Schneider
*Attorney, Agent, or Firm*—Sixbey, Friedman & Leedom

[57] ABSTRACT

A tennis racket having a hand-grip shell that can be moved longitudinally on the frame shaft. The hand-grip shell is formed of two half-shells made of a hard material which, by means of an elastic winding strip, a tube or several tube sections are pressed together so that the thus formed grip is held firmly on the shaft, but can still be moved longitudinally therealong. In addition, an adjusting device, such as an adjusting screw, is provided for adjusting the position of the hand-grip on the shaft. The result is that, in a simple manner, an easy individual lengthening or shortening of the grip can take place.

29 Claims, 8 Drawing Figures

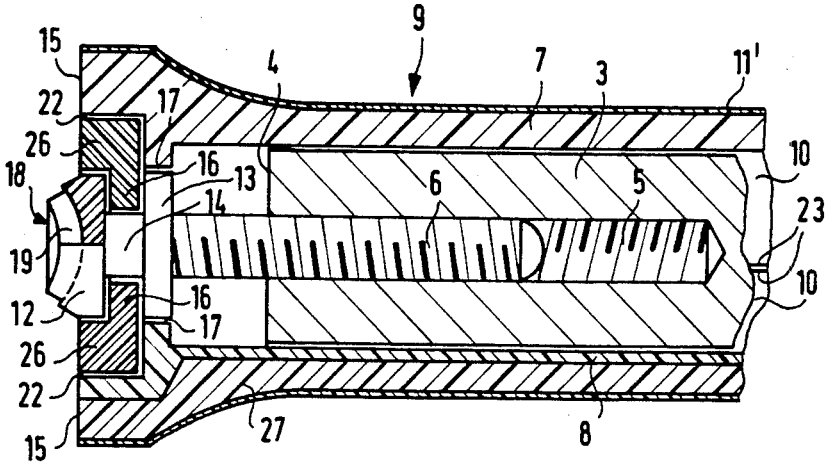
FIG. 2
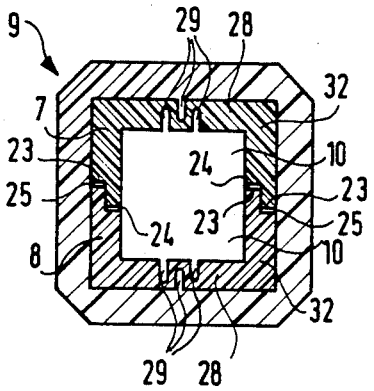
FIG. 3
FIG. 4
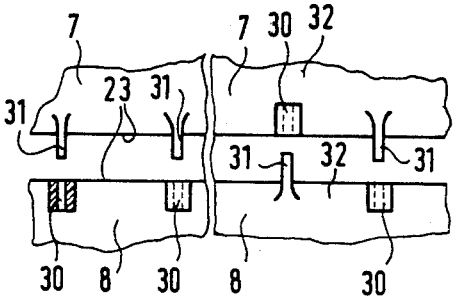
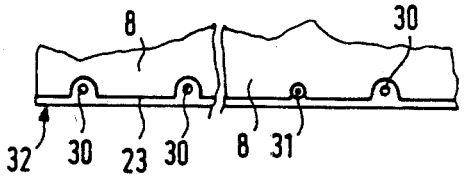
FIG. 5

RACKET WITH ADJUSTABLE HANDLE

BACKGROUND AND SUMMARY OF THE INVENTION

This invention relates to a racket having a stringed hitting surface surrounded by a frame with a hand-grip shaft to which a hand-grip formed of a pair of half-shells is attached, especially a tennis racket.

A racket, especially a tennis racket, of this type is known from DE-OS No. 21 06 800. The grip of this known tennis racket consists of a grip shell that is preferably formed of two half-shells, with said grip shell being firmly arranged on the shaft with an insert of a shock- or vibration-damping material being placed in-between. The two half-shells are joined together by screws which penetrate into the shaft through boreholes which are larger than the screw diameter, so that the screws do not come in contact with the walls of the boreholes. Therefore, in order to ensure that the grip does not slip on the shaft, the insert must be pressed firmly to the shaft by means of the screws. This measure has the purpose of avoiding the effect of hard impacts being transferred to the arm of the player in a undampened manner. However, the distance of the hand-grip from the hitting surface cannot be adjusted with such a known racket.

It is an object of the invention to develop a racket, especially a tennis racket, which is constructed such that the grip can easily, preferably also during the game, be moved toward or away from the hitting surface.

This objective is achieved in accordance with preferred embodiments of the present invention by utilizing half-shells of non-compressible material, but connecting them by elastic grip means which holds the half-shells firmly to the frame shaft, yet still enables the hand-grip to be moved longitudially therealong via an adjusting device. The adjusting device is secured to the hand-grip in a manner precluding axial and radial movement relative thereto and is interconnected with an end of the racket frame shaft in a longitudinally adjustable manner.

By using half-shells made of a hard material, or using a hard interior wall in the case of half-shells made of a soft compressible material, and by elastically fitting them together to form the hand-grip, by means of one or several elastic strips, an elastic tube or elastic tube sections, the grip may still be moved on the shaft even if the contact pressure of the half-shells is relatively high, by means of the adjusting device. The known grips, where the half-shells consist of a soft, preferably foamed and thus volume-compressible material or are connected with the shaft in a form-fitting manner, do not offer this possibility.

It is known to develop the grip of tennis rackets so it can be lengthened. Thus, on the basis of DE-PS No. 942 075 or DE-OS No. 20 29 533 it is known to slide and lock a sleeve-shaped grip on the shaft using a prestressed inside pressure spring. After the lock is released, the sleeve bounces back and causes an increase in the length of the grip. In this case, the lengthening or the shortening of the grip is always constant, i.e., intermediate positions are not possible.

A manual change of length without the use of a spring is known from De-OS No. 20 30 998. In this case, this change is achieved by the screwing-on or unscrewing of special shaft or grip parts of predetermined length.

All of these developments, in practice, are not particularly well suited for use during playing and have, therefore, not been successful on the market.

These and further objects, features and advantages of the present invention will become more obvious from the following description when taken in connection with the accompanying drawings which show, for purposes of illustration only several embodiments in accordance with the present invention.

BRIEF DESCRIPTION OF THE DRAWINGS

FIG. 2 is a longitudinal cross-sectional view of the grip of a tennis racket according to the invention, with the adjusting device in partial-section;

FIG. 3 is a cross-sectional view through a grip according to the invention having expansion joints;

FIG. 4 is a segment of an interior longitudinal side of two half-shells; and FIG. 5 is a partial view of a parting plane of a half-shell.

DETAILED DESCRIPTION OF THE PREFERRED EMBODIMENTS

Figures 1, 1A, 1B, 1C:
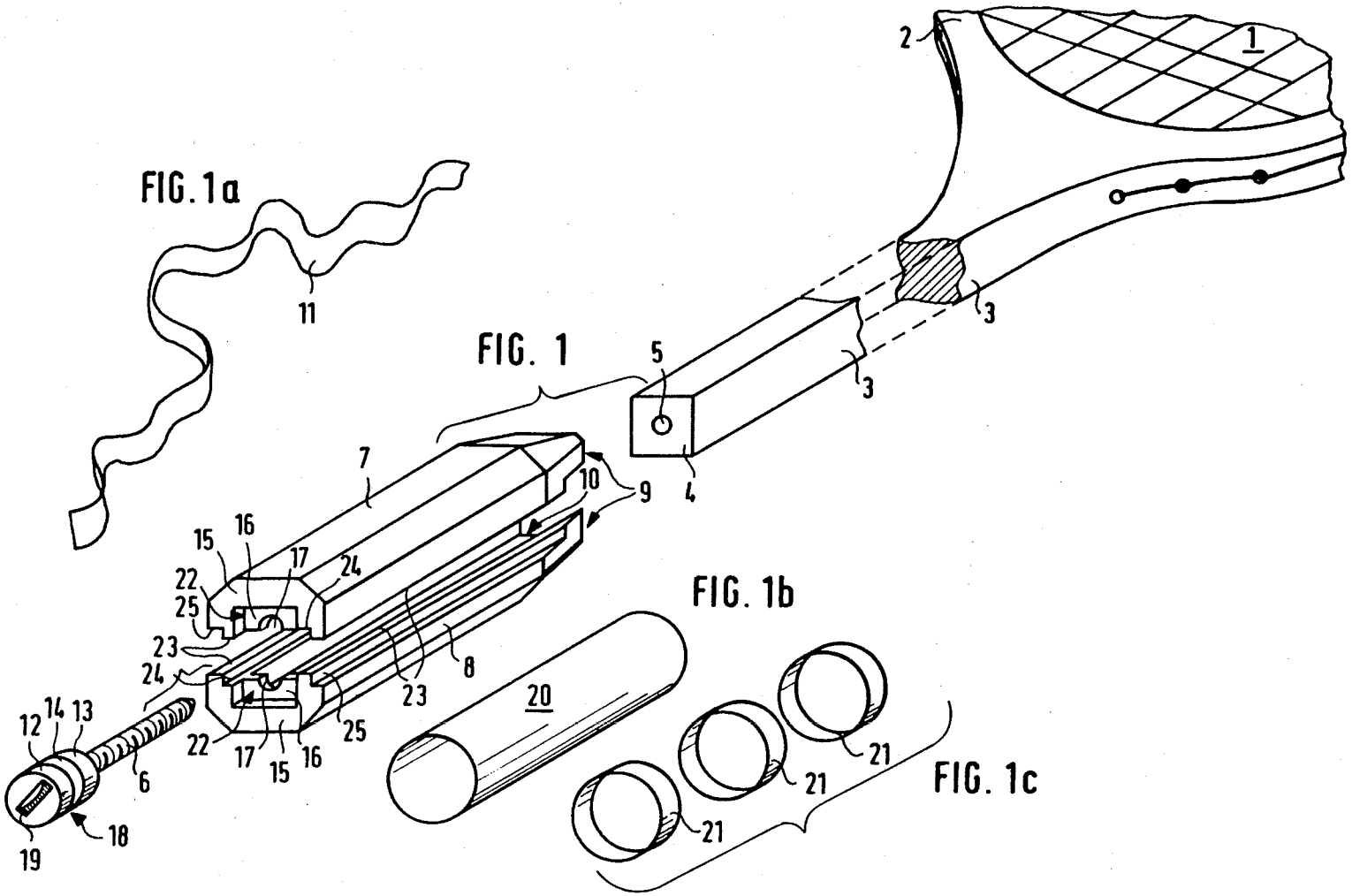
FIG. 1 is an exploded view of a tennis racket according to the invention.
FIG. 1*a* is a elastic strip for securement of the hand-grip shells.
FIG. 1*b* is a elastic tube for securement of the hand-grip shells.
FIG. 1*c* are elastic tube sections for securement of the hand-grip shells.

FIG. 1 shows a racket having a frame 2, which surrounds a stringed hitting surface 1. At one end of the racket, the frame is provided with a hand-grip shaft 3. The shaft 3, preferably is a single member of rectangular or square cross section, but it may be formed of two rods, for example, the ends of rods, if the frame is formed from a bent tube or a rod, as is known.

In the shaft end 4, a borehole 5 having a thread is provided and into which an adjusting screw 6 can be screwed. Where the shaft is formed of a pair of tubes or rods, a plate or block with a threaded hole would be attached at the end of the shaft to form an equivalent securement.

A hand-grip 9, formed of two half-shells 7 and 8, is put on the shaft 3. The half-shells 7, 8 consist of a hard, practically non-compressible, or non-springy material, such as rigid expanded plastic, especially a hard polyurethane, hard PVC, polyamide, polypropylene, polyethylene, etc. These materials have the characteristic that they will slide relatively well on a shaft 3 formed of wood, metal or plastic without experiencing much wear.

The two half-shells 7, 8, after being placed on the shaft 3, are wound with an elastic grip strip 11, as shown in FIG. 1*a*. By means of this strip 11, the half-shells 7, 8 are pulled toward one another and lie flush against the shaft 3. Nevertheless, the resultant hand-grip 9 can be moved relatively easily on the shaft 3 by means of the interior walls of the half-shell 7, 8. If necessary, the inside walls may be provided with longitudinal ribs which serve as sliding surfaces and may, possibly, at the same time be used for tolerance compensation.

In order to be able to adjust the grip 9 at any time, and so that it can be easily moved on the shaft 3, the adjusting screw 6, serving as the adjusting device, is provided between the hand-grip 9 and the shaft 3. The adjusting screw 6 is connected with the grip 9 by means of a tongue-and-groove connection. That is, the adjusting screw 6, at an outside end area, has a surrounding groove 14 that is formed between two guide disks 12, 13. Flange-like tongues 16 project inwardly at ends 15 of the half-shells 7, 8 and engage in the groove 14. In the illustrated embodiment, the flange-like tongues are formed by walls projecting toward the inside and having semicircular recesses 17 for the adjusting screw 6.

Thus, the adjusting screw 6 is mounted so that it cannot be moved in an axial or a radial direction, but can be turned. By turning the adjusting screw 6, it will be threaded into or out of the hole 5 so as to move the grip 9 longitudinally along the shaft 3 and it can be adjusted in its position relative to the hitting surface of the racket. For operation of the adjusting screw 6, the head 18 of the adjusting screw 6 is provided with a slot 19 into which an adjusting tool, coin or the like can be inserted. Alternatively, the head 18 may be formed as a manually graspable knob.

Instead of fitting the half-shells 7, 8 together by an elastic grip means in the form of the elastic strip 11, to form hand-grip 9, this fitting-together may also take place by elastic grip means in the form of an elastic tube 20, shown in FIG. 1*b*, such as a tube made of rubber, or in the form of elastic tube sections 21, according to FIG. 1*c*. The grip 9, the elastic grip means, i.e., elastic strip 11, tube 20 or tube sections 21, are then, in the conventional manner, still wound over with a grip band that does not have to be elastic.

Expediently, the flange-like tongues 16 are slightly displaced longitudinally toward the interior of the grip 9 so that the head 18 of the adjusting screw 6 is arranged within a recess 22.

The parting planes 23 of the half-shells 7, 8 are conveniently interlocked with one another by means of a tongue-and-groove connection or by grooved seams. Advantageously, this arrangement is made so that one of the parting planes 23 has a groove and the other one has a tongue or, as shown in FIGS. 1 and 3, one of the parting planes 23 has a grooved inside seam 24 and the other one has a grooved outside seam 25. Thus, the half-shells 7, 8 are constructed identically so that the two-piece grip can be formed while only one part is required to be manufactured.

Instead of the flange-like tongues 16 being a unitary part of the half shells 7, 8, according to another advantageous feature of the invention, the flange-like tongues 16 may be formed by special sliding members 26 (FIG. 2), consisting of a highly wear-resistant material of low friction. This tube of material would, for example, be a polyamide, polycarbonate, aluminum, brass, steel or a similar material. Preferably, two sliding members 26 that can be placed together to form a disk are used. The disk formed of members 26 can be inserted in the recess 22 at the end 15 of the grip 9, and can be fastened there. The fastening, preferably, takes place by screws and/or gluing.

The contour of the perimeter of recess 22 is advantageously not circular, and the sliding members 26 are conformingly shaped to this contour so that they are held in the recess 22 and cannot turn relative to the shells in order to facilitate the members being fastened by locking (such a by set-screws or pins) and/or gluing.

In an expedient development of the invention, the half-shells 7, 8 may be provided with a soft-elastic exterior layer 27 (shown on the bottom half-shell 8 in FIG. 2), such as a foamed material, foam rubber or a similar material or they may subsequently be surrounded by it, for example, by spraying. However, this layer 27 may still, even if it represents a uniform cover, be provided with the elastic grip strip 11 and/or tube 20 or the tube sections 21. The provision of elastic layer 27 results in a good dampening of hard blows and impacts so that they are not transferred directly to the hitting arm of the player.

In order to balance tolerances or in order not to have to manufacture parts with especially great precision, at least one expansion joint 29 may be provided at least in one wall of the half-shell 7, 8, preferably in the wall 28 between the parting planes 23. This expansion joint or these expansion joints is/are advantageously formed by longitudinal grooves extending alternating from the inside to the outside, and from the outside to the inside, as shown in FIG. 3 in a cross section.

Instead of a groove-and-tongue connection at the parting planes 23 or instead of a grooved inside seam 24 and a grooved outside seam 25, according to FIG. 4 and 5, in the area of the parting planes 23, bushings 30 and/or pins 31 may be provided along said parting planes 23 at a distance from one another. These are arranged in such a way that, when the two half-shells 7, 8 are placed together, one pin 31 of one half-shell 7 or 8, in each case, fits into the bushing 30 of the other half-shell 8 or 7. For example, in the area of a parting plane 23 of a half-shell 7 or 8, only bushings 30 may be provided and in the area of the other parting line 23 of the half-shell 7 or 8, only pins 31 may be provided (FIGS. 4 and 5, on the left), or in the area of each parting line 23 of a half-shell 7, 8 bushings 30 and pins 31 may be provided alternately, namely in such a way that when two identical half-shells 7, 8 are fitted together, one pin 31 is in each case opposite one bushing 30 and these can be fitted into one another (FIGS. 4 and 5, on the right). Expediently, at least the pins 31 taper off slightly conically toward the end, for example, at an angle of 1 to 5 degrees, so that they wedge when they are pressed into the bushing 30. Advantageously, the thickness of the pins 31 and the width of the boreholes of the bushing 30, as well as the length of the wall parts 32 of the half-shells 7, 8 bordering on the parting line 23, are dimensioned so that when the half shells 7, 8 rest against the shaft 3, a small gap remains between the pair of parting planes 23 bordering on one another, and the bushings 30 and the pins 31 despite this fact already result in a relatively firm plug-and-socket connection which holds the thus obtained grip 9 on the shaft 3 for further processing.

The length of the adjusting screw 6 and the depth of the borehole 5 are dimensioned in such a way that the grip 9 can be moved on the shaft about 20 mm to 40 mm. However, as tests have shown, an adjustment by $\pm 10$ mm from the normal position is, as a rule, sufficient. Furthermore, use of a screw as an adjusting means enables a continuous, as opposed to a step-wise, adjustment, thereby providing an individual with the maximum freedom of choice.

Even though the main field of application of the invention concerns tennis rackets, the invention may advantageously also be used for other types of rackets, such as squash rackets, badminton rackets, racketball rackets, and others.

While we have shown and described several embodiments in accordance with the present invention, it is understood that the same is not limited thereto but is susceptible of numerous changes and modifications as known to those skilled in the art and we therefore do not wish to be limited to the details shown and modifications as are encompassed by the scope of the appended claims.

I claim:

1. A racket having a frame surrounding a stringed hitting surface, said frame being provided with a hand-grip shaft, said hand grip shaft having one end attached to said frame and a free end, the hand-grip shaft being surrounded by a hand-grip formed of two half-shells which, at least in part, engage against the hand-grip shaft, at least the parts of the shells that engage the hand-grip shaft being formed of hard, substantially non-compressible material, wherein an elastic grip means in a form selected from the group consisting of an elastic winding strip, an elastic tube and several elastic tube sections surrounds the half-shells in a manner causing them to be pressed together so firmly that the hand-grip rests firmly on the hand-grip shaft, but is movable longitudinally along the hand-grip shaft, and wherein an adjusting means is provided for adjusting the position of the hand-grip relative to the hitting surface, said adjusting means being secured to the hand-grip in a manner precluding axial and radial movement relative thereto and while at the same time being interconnected with said free end of said hand grip shaft in a longitudinally adjustable manner.

2. A racket according to claim 1, where said adjusting means is continuously adjustable.

3. A racket according to claim 2, wherein the adjusting means comprises an adjusting screw that is held in an end of the half-shells by a tongue-and-groove connection which provides said preclusion of movement in axial and radial directions, but permits the adjusting screw to be turned for producing the longitudinal adjustment of the hand-grip relative to the hitting surface.

4. A racket according to claim 3, wherein in the area of parting plane walls of the half-shells, along the parting planes, each half-shell is provided with pins, bushings or pins and bushings mounted at a distance from one another so that, when the two half-shells are placed together to form the hand-grip, each pin or bushing of one half-shell is disposed opposite a bushing or pin of the other half-shell so that they can be inserted one into the other.

5. A racket according to claim 4, wherein the length of the pins and size of the bushings is such that, when the pins and bushings arre firmly engaged, the half-shells are held together with a gap therebetween.

6. A racket according to claim 3, wherein the tongue-and-groove connection comprises one of a tongue and a groove on the hand-grip interacting with the other of a tongue and a groove on the adjusting screw, and wherein the tongue or groove of the hand-grip comprises at least one sliding member that is a separate part from the half-shells and is formed of a material having a higher resistance to wear than that of the half-shells forming the hand-grip.

7. A racket according to claim 6, wherein the at least one sliding member is held in a recess of the end of the half-shells.

8. A racket according to claim 7, wherein the at least one sliding member is secured within the recess by screws.

9. A racket according to claim 7, wherein the at least one sliding member is locked into the recess.

10. A racket according to claim 7, wherein the at least one sliding member is glued into the recess.

11. A racket according to claim 10, wherein the at least one sliding member is secured within the recess by screws.

12. A racket according to claim 6, wherein the at least one sliding member is fixed in position against turning in the direction of the rotation of the adjusting screw.

13. A racket according to claim 12, wherein a wall of each half-shell has at least one expansion joint extending over the whole length of the half-shell.

14. A racket according to claim 13, wherein the half-shells, on their exterior, are surrounded by layer of a soft-elastic material, and wherein the elastic grip means surrounds this layer.

15. A racket according to claim 13 wherein the half-shells are formed in such a way that two identically shaped half-shells can be placed together to form the hand-grip.

16. A racket according to claim 15, wherein a parting wall on one side of the half-shells has a grooved outside seam and a parting wall on the opposite side has a grooved inside seam.

17. A racket according to claim 13, wherein in the area of parting plane walls of the half-shells, along the parting planes, each half-shell is provided with pins, bushings or pins and bushings mounted at a distance from one another so that, when the two half-shells are placed together to form the hand-grip, each pin or bushing of one half-shell is disposed opposite a bushing or pin of the other half-shell so that they can be inserted one into the other.

18. A racket according to claim 17, wherein the length of the pins and size of the bushings is such that, when the pins and bushings are firmly engaged, the half-shells are held together with a gap therebetween.

19. A racket according to claim 6, wherein a wall of each half-shell has at least one expansion joint extending over the whole length of the half-shell.

20. A racket according to claim 19, wherein the half-shells on their exterior, are surrounded by a layer of a soft-elastic material, and wherein the elastic grip means surrounds this layer.

21. A racket according to claim 6, wherein the half-shells on their exterior, are surrounded by a layer of a soft-elastic material, and wherein the elastic grip means surrounds this layer.

22. A racket according to claim 6 wherein the half-shells are formed in such a way that two identically shaped half-shells can be placed to form the hand-grip.

23. A racket according to claim 22, wherein a parting wall on one side of the half-shells has a grooved outside seam and a parting wall on the opposite side has a grooved inside seam.

24. A racket according to claim 1, wherein a wall of each half-shell has at least one expansion joint extending over the whole length of the half-shell.

25. A racket according to claim 24, wherein the half-shells on their exterior, are surrounded by layer of a soft-elastic material, and wherein the elastic grip means surrounds this layer.

26. A racket according to claim 1, wherein the half-shells on their exterior, are surrounded by a layer of a soft-elastic material, and wherein the elastic grip means surrounds this layer.

27. A racket according to claim 1 wherein the half-shells are formed in such a way that two identically shaped half-shells can be placed together to form the hand-grip.

28. A racket according to claim 27, wherein in the area of parting plane walls of the half-shells, along the parting planes, each half-shell is provided with pins, bushings or pins and bushings mounted at a distance from one another so that, when the two half-shells are placed together to form the hand-grip, each pin or bushing of one half-shell is disposed opposite a bushing or pin of the other half-shell so that they can be inserted one into the other.

29. A racket according to claim 27, wherein a parting wall on one side of the half-shells has a grooved outside seam and a parting wall on the opposite side has a grooved inside seam.

* * * * *